US005184588A

United States Patent [19]

Kato et al.

[11] Patent Number: 5,184,588

[45] Date of Patent: Feb. 9, 1993

[54] ENGINE CONTROL APPARATUS

[75] Inventors: Tatsunori Kato, Nagoya; Katsuhiko Kawai; Shigenori Isomura, both of Kariya, all of Japan

[73] Assignee: Nippondenso Co., Ltd., Kariya, Japan

[21] Appl. No.: 846,333

[22] Filed: Mar. 6, 1992

[30] Foreign Application Priority Data

Mar. 7, 1991 [JP] Japan ..... 3-42080

[51] Int. Cl.[5] ..... F02M 3/00

[52] U.S. Cl. ..... 123/339

[58] Field of Search ..... 123/339, 419, 436, 480; 364/431.07, 431.04, 431.05

[56] References Cited

U.S. PATENT DOCUMENTS 4,785,780 11/1988 Kawai ..... 123/339
5,076,230 12/1991 Ohkuono ..... 123/339
5,081,973 1/1992 Minamitani ..... 123/339

FOREIGN PATENT DOCUMENTS 59-43943 3/1984 Japan .
18336 1/1989 Japan .

*Primary Examiner*—Raymond A. Nelli

*Attorney, Agent, or Firm*—Cushman, Darby & Cushman

[57] ABSTRACT

An engine control apparatus comprises: an actual control condition detector for detecting an actual control condition of an engine; an adjusting device for adjusting the actual control condition of the engine; and a controller for controlling the adjusting device such that the actual control condition of the engine is controlled to a target control condition using a state variable amount and a feedback constant determined on the basis of a dynamic model of the engine, wherein the controller has: a predicated control condition operation circuit for operating a predicted control condition on the basis of the dynamic model of the engine; a deviation operation circuit for operating a deviation of the predicated control condition from the target control condition; a changing circuit for changing control of the controller such that fluctuations of the control condition become small in accordance with a judgement made such that an error of the dynamic model exceeds a tolerance when the deviation exceeds a predetermined value. According to this invention, there is an advantage effect that fluctuation of the engine speed is suppressed because of prevention of hunting due to reduction of variation in the control amount.

9 Claims, 11 Drawing Sheets

ENGINE CONTROL APPARATUS

BACKGROUND OF THE INVENTION

1. Field of the Invention

This invention relates to an engine control apparatus for controlling a condition of an internal combustion engine and particularly to an engine control apparatus for controlling an engine speed of an internal combustion engine at idling operation and an engine control apparatus for controlling an air fuel ratio of an internal combustion engine.

2. Description of the Prior Art

As one of engine control apparatus, an idling engine speed control apparatus is known which uses the so-called modern controlling technique where a control amount of an auxiliary air control valve or the like is operated in accordance with an optimal feedback gain predetermined by a simulation with an estimation function or the like and with a state variable amount representing an internal condition of an engine. It controls the engine speed of an internal combustion engine to a target speed by determining an air flow rate of the idling operation from a detected engine speed through a dynamic model of the engine such technique is disclosed in, for example, Japanese patent application provisional publication No. 64-8336 whose corresponding application is U.S. Pat. No. 4,785,780.

However, in the apparatus mentioned above, there is a problem that hunting occurs as shown in FIGS. 11A, 11B, and 11C showing controlled conditions according to the prior art engine control apparatus because the engine speed is not properly controlled if the control mentioned above is carried out in the condition that an air fuel ratio deviates from an theoretical air fuel ratio (for example, in the over-rich or over-lean conditions), that is, in the condition that an model error will occur because the dynamic model mentioned above is determined on the assumption that the air fuel ratio is within a theoretical air fuel ratio range.

It is necessary to determine a dynamic model including the air fuel ratio factor in order to prevent this hunting. However, there is a problem that much manpower is required for determining the feedback constants if the model is determined with the air fuel factor included in the dynamic model, that is, the model is determined with an addition of an input. Moreover, there is a problem that a load to an electric control portion will increase because much storing capacity is necessary to store feedback gains in accordance with respective engine conditions.

SUMMARY OF THE INVENTION

The present invention has been developed in order to remove the above-described drawbacks inherent to the conventional engine control apparatus.

According to the present invention there is provided an engine control apparatus comprising: an actual control condition detection portion for detecting an actual control condition of an engine; an adjusting portion for adjusting the actual control condition of the engine; and a control portion for controlling the adjusting portion such that the actual control condition of the engine is controlled to a target control condition using state variable amount and a feedback constant determined on the basis of a dynamic model of the engine, wherein the control portion has: a predicated control condition operating portion for operating a predicted control condition on the basis of the dynamic model of the engine; a deviation operation portion for operating a deviation of the predicated control condition from the target control condition; and a changing portion for changing control of the controller such that fluctuations of the control condition become small in accordance with a judgement made such that an error of the dynamic model exceeds a tolerance when the deviation exceeds a predetermined value.

According to the present invention there is also provided an engine control apparatus comprising: an actual control value detection portion for detecting an actual control value of an engine; an adjusting portion for adjusting the control condition of the engine; a control portion for operating a control amount for controlling the adjusting portion such that the actual control value agrees with the target value and for outputting a control signal in accordance with the control amount; wherein the control portion has: a predicated control amount operation portion for operating a predicted control value on the basis of a dynamic model of the engine; a deviation operation portion for operating a deviation of the predicated control amount from the actual control value; an integral term operation portion for operating an integral term of the deviation of the actual control value from the predicted control amount; a state variable determining portion for determining a state variable on the basis of the integral term, the actual control amount, and the control amount; a memory for storing a first feedback gain predetermined on the basis of the model and a second feedback gain inferior to the first feedback gain in responsibility; a first control amount determining portion for determining the control amount in accordance with the first feedback gain and the state variable amount; a second control amount determining portion for determining the control amount in accordance with the second feedback gain and the state variable amount; and a portion for determining the control amount using the first control amount determining portion when the deviation from the deviation operation portion does not exceed a predetermined value and for determining the control amount using the second control amount determining portion when the deviation from the deviation operation portion exceeds the predetermined value.

According to the present invention there is further provided an engine control apparatus comprising: an actual control value detection portion for detecting an actual control value of an engine; an adjusting portion for adjusting the control condition of the engine; and a control portion for operating a control amount for controlling the adjusting portion such that the actual control value agrees with the target value and for outputting a control signal in accordance with the control amount; wherein the control portion has: a predicated control amount operation portion for operating a predicted control value on the basis of a dynamic model of the engine; a deviation operation portion for operating a deviation of the predicated control amount from the actual control value; an integral term operation portion for operating an integral term of the deviation of the actual control value from the predicted control amount; a state variable amount determining portion for determining a state variable amount on the basis of the integral term, the actual control amount, and the control amount; a first control amount determining portion for determining the control amount on the basis of a first feedback gain predetermined on the basis of the dynamic model and of the state variable amount; a second control amount determining portion for setting the control amount to a predetermined value through open processing; and a portion for determining the control amount using the first control amount determining portion when the deviation from the deviation operation portion does not exceed a predetermined value and for determining the control amount using the second control amount determining portion when the deviation from the deviation operation portion exceeds the predetermined value.

According to the present invention there is further provided an engine control apparatus comprising: engine speed detect portion for detecting an engine speed of an engine; an engine speed adjusting portion for adjusting the engine speed of the engine; control portion for operating a control amount for controlling the engine speed adjusting portion such that the engine speed during idling operation of the engine agrees with a target value and for outputting a control signal in accordance with the control amount; wherein the control portion has: a predicated control amount operation portion for operating a predicted control value on the basis of a dynamic model of the engine; a deviation operation portion for operating a deviation of the predicated control amount from the engine speed; an integral term operation portion for operating an integral term of the deviation of the engine speed from the target value; a state variable amount determining portion for determining a state variable amount on the basis of the integral term, the engine speed, and the control amount; a memory for storing a first feedback gain predetermined on the basis of the model and a second feedback gain inferior to the first feedback gain in responsibility; a first control amount determining portion for determining the control amount in accordance with the first feedback gain and the state variable amount; a second control amount determining portion for determining the control amount in accordance with the second feedback gain and the state variable amount; a portion for determining the control amount using the first control amount determining portion when the deviation from the deviation operation portion does not exceed a predetermined value and for determining the control amount using the second control amount determining portion when the deviation from the deviation operation portion exceeds the predetermined value.

According to the present invention there is provided an engine control apparatus comprising: an engine speed detection portion for detecting an engine speed of an engine; an engine speed adjusting portion for adjusting the engine speed of the engine; a control portion for operating a control amount for controlling engine speed adjusting portion such that the engine speed during idling operation of the engine agrees with the target value and for outputting a control signal in accordance with the control amount; wherein the control portion has: a predicated engine speed operation portion for operating a predicted control value on the basis of a dynamic model of the engine; a deviation operation portion for operating a deviation of the predicated engine speed from the engine speed; an integral term operation portion for operating an integral term of the deviation of the engine speed from the predicted engine speed; a state variable amount setting portion for determining a state variable amount on the basis of the integral term, the engine speed, and the control amount; a first control amount determining portion for determining the control amount on the basis of a first feedback gain predetermined on the basis of the dynamic model and of the state variable amount; a second control amount determining portion for setting the control amount to a predetermined value through an open processing; and a portion for determining the control amount using the first control amount determining portion when the deviation from the deviation operation portion does not exceed a predetermined value and for determining the control amount using the second control amount determining portion when the deviation from the deviation operation portion exceeds the predetermined value.

BRIEF DESCRIPTION OF THE DRAWINGS

The object and features of the present invention will become more readily apparent from the following detailed description taken in conjunction with the accompanying drawings in which.

The same or corresponding elements or parts are designated as like references throughout the drawings.

DETAILED DESCRIPTION OF THE INVENTION

Hereinbelow will be described a first embodiment of this invention of an engine control apparatus.

Figure 1:
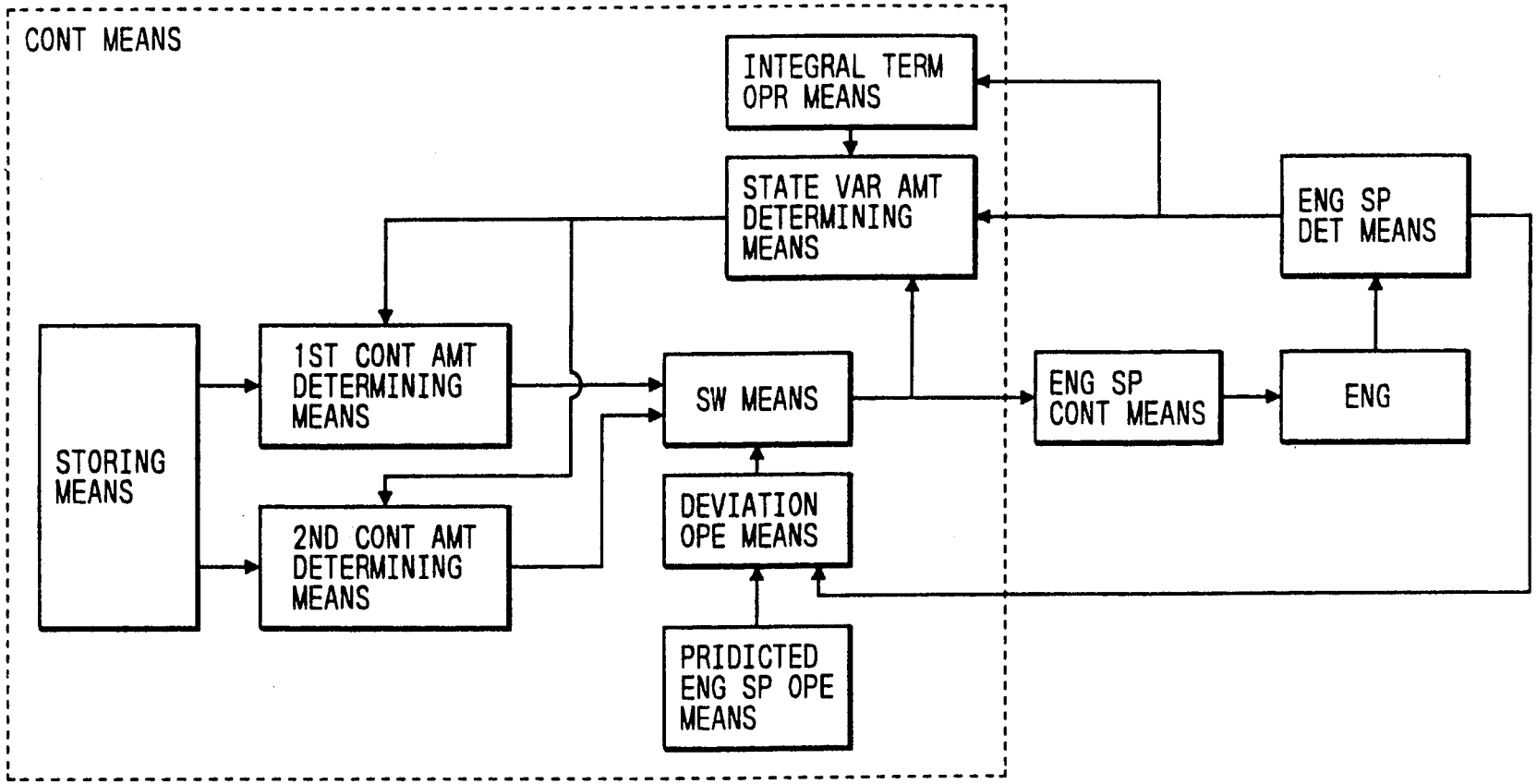
FIG. 1 is a functional block diagram of the first embodiment of this invention.
Figure 2:
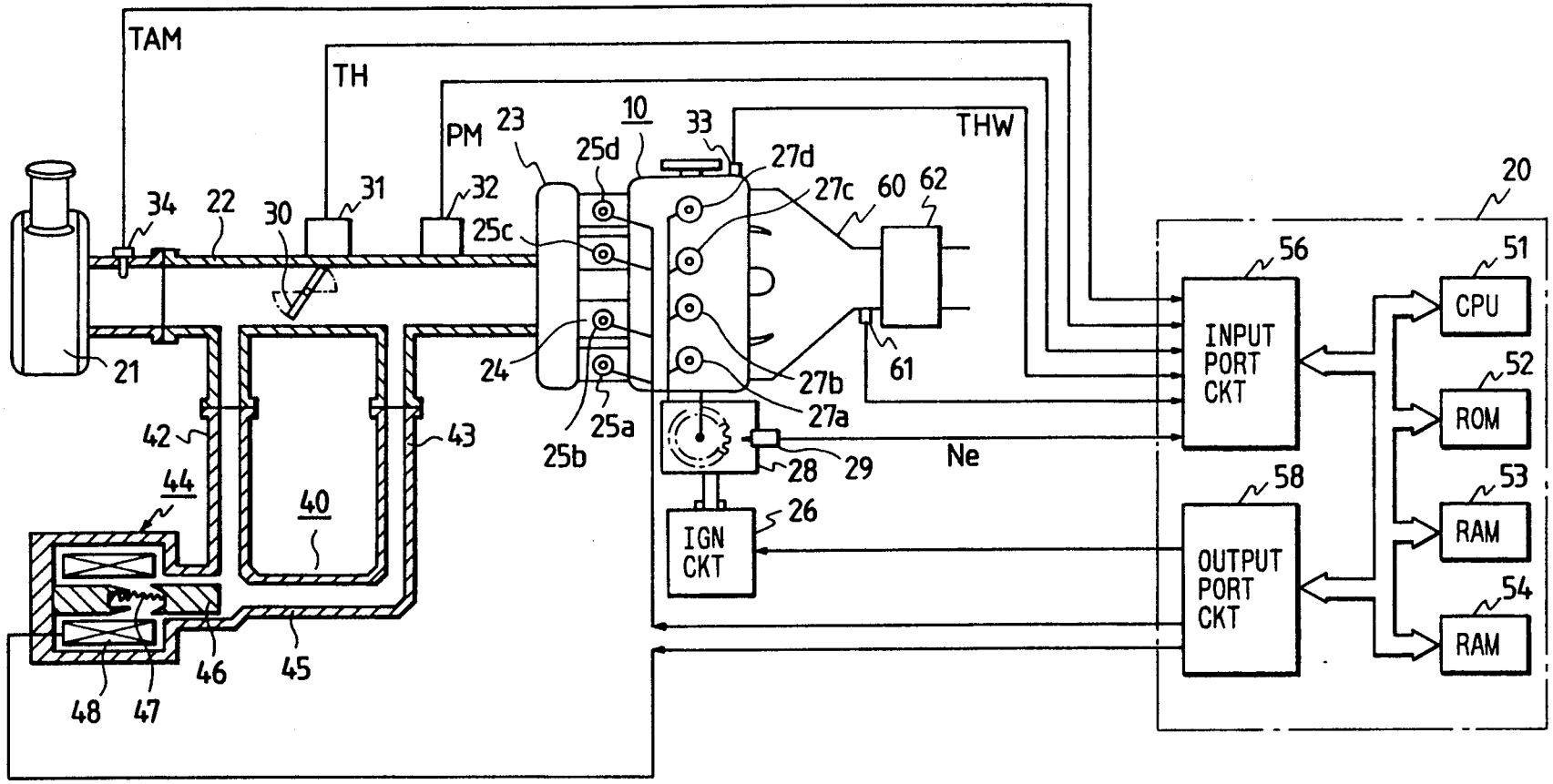
FIG. 2 is a block diagram of the first embodiment of this invention of an idling engine speed control apparatus as an example of engine control apparatus.

FIG. 2 is a block diagram of the first embodiment of this invention of an idling engine speed control apparatus as an example of engine control apparatus. FIG. 1 is a functional block diagram of the first embodiment of this invention.

As shown in drawings, in this embodiment, controlling of the ignition timing, air fuel ratio, idling engine speed and the like are executed by an electric control unit (ECU) 20. In this embodiment, the controlling of an engine speed at idling operation (idling engine speed) is mainly described.

The engine 10 is a spark-ignition-type four-cylinder four-cycle engine mounted on a not-shown vehicle.

The intake air is introduced to each of cylinders through an air cleaner 21, an intake manifold 22, a surge tank 23, and an intake branched pipe 24. Fuel is supplied from a not-shown fuel tank with a pressure and is injected from fuel injection valves 25a–25c provided to the intake branched pipe 24.

There is provided to an exhaust manifold 60: an oxygen sensor 61 for detecting the air fuel ratio of a mixture of the intake air and fuel supplied to the engine 10; and a catalytic converter rhodium 62 for cleaning deleterious substances (CO, HC, and NOx) included in an exhaust gas. As generally known, the oxygen sensor 61 outputs a different output voltage in accordance with whether the air fuel ratio is rich or lean with respect to an ideal air fuel ratio λ0.

A distributor 28 is provided to the engine 10, which distributes high voltage signals supplied from an ignition circuit 26 to each of ignition plugs 27a–27d provided to cylinders. In the distributor 28, an engine speed sensor 29 for detecting an engine speed Ne of the engine 10 is provided. A throttle sensor 31 is provided to the intake manifold 22 and is connected to a throttle valve 30 for detecting an opening degree TH of the throttle valve 30. Other sensors are provided as follows:

A pressure sensor 32 for detecting an intake air pressure PM downstream from the throttle valve 30 is provided to a downstream portion of the intake manifold 22. An intake air temperature sensor 34 for detecting an intake air temperature TAM is provided to an upstream portion of the intake manifold 22. An warm-up sensor 33 for detecting a temperature THW of cooling water of the engine 10 is provided to a body of the engine 10.

The engine speed sensor 29 is so provided as to confront a ring gear rotating with a crank shaft of the engine 10. It generates twenty-four pulses per one rotation of the engine 10, i.e., 720° CA (crank angle). Frequency of the pulses is proportional to the engine speed Ne. The throttle sensor 31 generates an analog signal whose intensity is proportional to the opening degree TH of the throttle valve 30 and an ON-OFF signal by an idle switch indicative of a full close state (idling state) of the throttle valve 30.

There is provided to an intake air system, a bypass passage 40 is so provided as to bypass the throttle valve 30 for controlling a flow rate of the intake air AR during idling of the engine 10. The bypass passage 40 comprises air passage pipes 42 and 43 and an air control valve (hereinbelow referred to as ISC valve) 44. The ISC valve 44 comprises a proportional electromagnetic type (linear solenoid) of a control valve which varies a cross-sectional area of an air passage between the air passage pipes 42 and 43 by controlling a position of a plunger 46 which is movable in a housing 45. The ISC valve 44 is so set that the plunger 46 allows the cross-sectional area to be zero by a compression coil spring 47. When an exciting current flows in an exciting coil 48, the plunger 46 is driven to open the air passage in the housing 45. An air flow rate of the bypass passage 40 is controlled by the exciting current. The exciting current is controlled by pulse width modulation (PWM). This ISC valve 44 is controlled by the ECU 20 together with the fuel injection valve 25a–25d and the ignition circuit 26. In addition to this, other types of valve can be used for this control, for example, a diaphragm-control valve or a step-motor driven valve.

The ECU 20 comprises a central processing unit (CPU) 51, a read only memory (ROM) 52, a random access memory (RAM) 53, a backup RAM 54, an input port circuit 56, and an output port circuit 58. The input port circuit 56 receives signals from the above-mentioned various sensors and sends them to the central processing unit 51. The output port circuit 58 sends control signals from the central processing unit to various actuators. The electric control unit 20 receives, through the input port circuit 56, an intake air flow rate AR, the intake air temperature TAM, the opening degree TH of the throttle 30, the temperature THW of cooling water, and the engine speed Ne, etc. to produce control signals to the fuel injection valves 25a–25d, the ignition circuit 26, and the ISC valve 44 through the output port circuit 58 after it calculates a fuel supply rate $\tau$, ignition timing Ig, and the duty ratio DR for controlling opening degree of the ISC valve 44 in accordance with signals from the various sensor received through the input port circuit 56.

The electric control unit 20 is designed to effect the idling engine speed control in accordance with the following method which is disclosed in the Japanese patent application provisional publication No. 64-8336.

(a) modeling of controlled object

In this embodiment, a model of controlling the engine speed during idling operation of the engine 10 (idling engine speed) under the following condition:

An autoregressive moving average model is used whose degree is assumed as [2,2] because it is assumed that n=m=2. Moreover, it is assumed that a time lag delay p caused by a sampling interval (dead time) is assumed as p=6. Further, a disturbance d is considered.

Therefore, approximation of the model is given by:

$$Ne(i)=a1\cdot Ne(i-1)+a2\cdot Ne(i-2)+b1\cdot u(i-7)+b2\cdot u(i-8)+d(i-1) \quad (1)$$

where u shows a control amount of the ISC valve 44 which corresponds to a duty ratio of a pulse signal applied to the exciting coil 48 in this embodiment and i is a variable indicative of frequency of controlling from beginning of the first sampling.

It is easy to determine a transfer function G of the system for controlling the idling engine speed using the step response to the model approximated as mentioned above and to experimentally determine various constants a1, a2, b1, and b2 of the model mentioned above. The model for controlling the idling engine speed has been determined by determination of respective constants a1, a2, b1, and b2.

(b) method of representing a state variable amount IX

Using a state variable amount given by:

$$IX(i)=[X1(i)X2(i)X3(i)X4(i)X5(i)X6(i)X7(i)X8(i)X(i)]^T, \quad (2)$$

then, Eq. 1 is rewritten as follows:

$$\begin{bmatrix} X1(i+1) \\ X2(i+1) \\ X3(i+1) \\ X4(i+1) \\ X5(i+1) \\ X6(i+1) \\ X7(i+1) \\ X8(i+1) \\ X9(i+1) \end{bmatrix} = \begin{bmatrix} a1 & a2 & 0 & 0 & 0 & 0 & 0 & b1 & b9 \\ 1 & 0 & 0 & 0 & 0 & 0 & 0 & 0 & 0 \\ 0 & 1 & 0 & 0 & 0 & 0 & 0 & 0 & 0 \\ 0 & 0 & 1 & 0 & 0 & 0 & 0 & 0 & 0 \\ 0 & 0 & 0 & 1 & 0 & 0 & 0 & 0 & 0 \end{bmatrix} \begin{bmatrix} X1(i) \\ X2(i) \\ X3(i) \\ X4(i) \\ X5(i) \end{bmatrix} + \quad (3)$$

-continued $$\begin{bmatrix} 0 & 0 & 0 & 0 & 1 & 0 & 0 & 0 & 0 \\ 0 & 0 & 0 & 0 & 0 & 1 & 0 & 0 & 0 \\ 0 & 0 & 0 & 0 & 0 & 0 & 1 & 0 & 0 \\ 0 & 0 & 0 & 0 & 0 & 0 & 0 & 1 & 0 \end{bmatrix} \begin{bmatrix} X6(i) \\ X7(i) \\ X8(i) \\ X9(i) \end{bmatrix}$$

$$\begin{bmatrix} 0 \\ 0 \\ 1 \\ 0 \\ 0 \\ 0 \\ 0 \\ 0 \\ 0 \end{bmatrix} u(i) + \begin{bmatrix} 1 \\ 0 \\ 0 \\ 0 \\ 0 \\ 0 \\ 0 \\ 0 \\ 0 \end{bmatrix} d(i)$$

Thus, the state variable amount IX (i) is given by:

$$X1(i)=Ne(i),\ X(i)=Ne(i-1),\ X3(i)=u(i-1),$$

$$X4(i)=u(i-2),\ X5(i)=u(i-3),\ X6(i)=u(i-4),$$

$$X7(i)=u(i-5),\ X8(i)=u(i-6),\ X9(i)=u(i-7) \quad (4)$$

(c) design of a regulator

A regulator is designed with respect to Eqs. 3 and 4. Using an optimal feedback gain given by:

$$IK=[K1\ K2\ K3\ K4\ K5\ K6\ K7\ K8\ K9]$$

and state variable amount given by:

$$IX(i) = \quad (5)$$

$$[X1\ (i)\ X2\ (i)\ X3\ (i)\ X4\ (i)\ X5\ (i)\ X6\ (i)\ X7\ (i)\ X8\ (i)\ X9\ (i)]^T =$$

$$[Ne\ (i)\ Ne\ (i-1)\ u\ (i-1)\ u\ (i-2)\ u\ (i-3)\ u\ (i-4)\ u\ (i-5)\ u\ (i-6)\ u\ (i-77)],$$

a control value u (i) of the ISC valve 44 is given by:

$$u\ (i) = IK \cdot IX\ (i) = \quad (7)$$

$$K1 \cdot Ne\ (i) + K2 \cdot Ne\ (i-1) + K3 \cdot u\ (i-1) + K4 \cdot u\ (i-2) + K5 \cdot u\ (i-3) + K6 \cdot u\ (i-4) + K7 \cdot u\ (i-5) + K8 \cdot u\ (i-6) + K9 \cdot u\ (i-7)$$

Further, adding an integral term uI (i) to this equation in order to absorb errors, the control value U (i) of the ISC valve 44 is given by:

$$u\ (i) = K1 \cdot Ne\ (i) + K2 \cdot Ne\ (i-1) + K3 \cdot u\ (i-1) + K4 \cdot u\ (i-2) + K5 \cdot u\ (i-3) + K6 \cdot u\ (i-4) + K7 \cdot u\ (i-5) + K8 \cdot u\ (i-6) + K9 \cdot u\ (i-7) + uI(i) \quad (8)$$

where the integral term uI (i) is given by a deviation NF-Ne (i) of the engine speed Ne (i) from a target engine speed NF and the integral constant Ka and it is given by:

$$UI(i)=uI(i-1)+Ka(NF-Ne(i) \quad (9)$$

Hereinbelow it is assumed that the state variable amount IX (i) includes the integral term uI (i) and that the optimal feedback gain IK includes the integral constant Ka.

Figure 3:
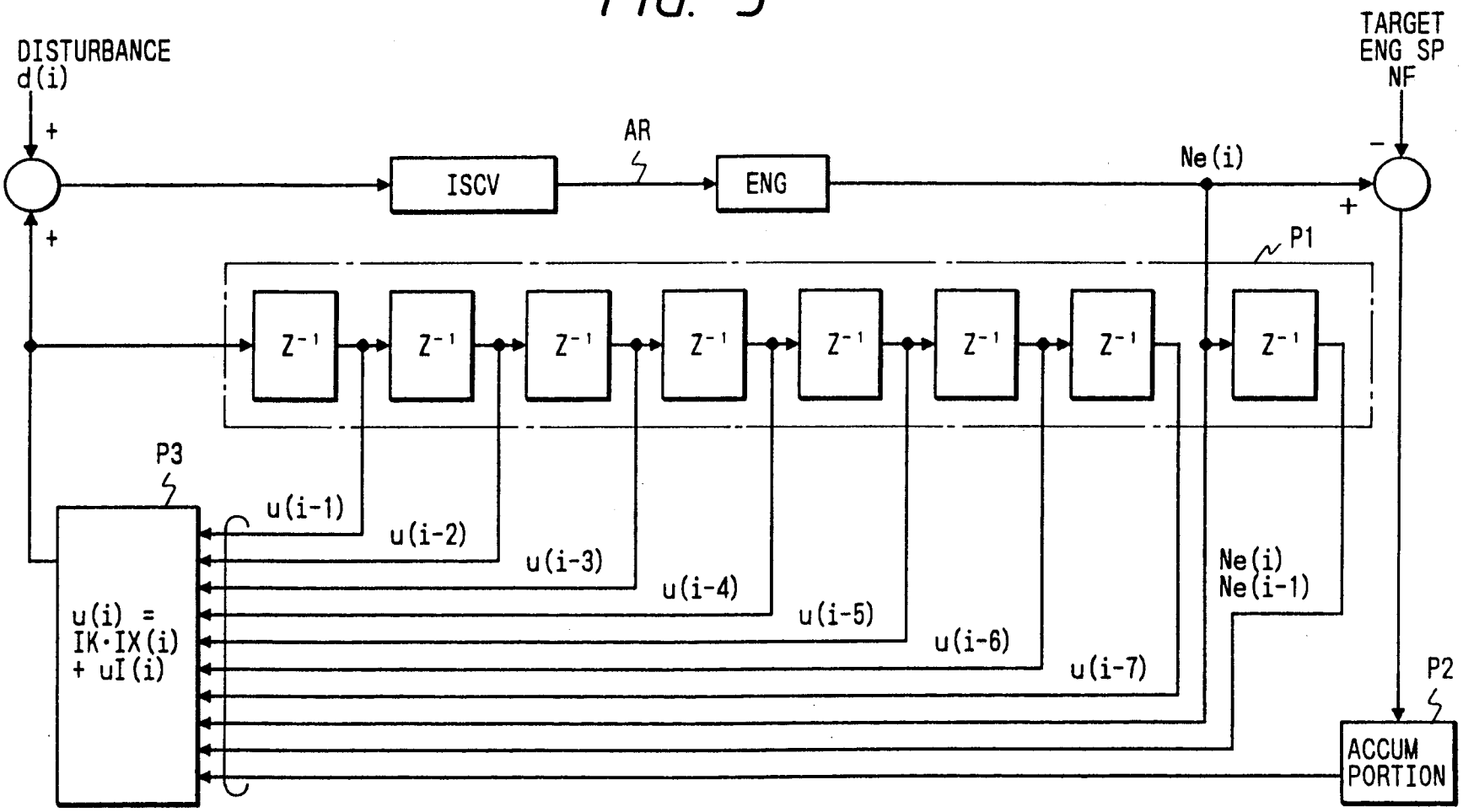
FIG. 3 is a block diagram of the system modeled of this embodiment for controlling the engine speed at the idling operation.

FIG. 3 is a block diagram of the system modeled as mentioned above for controlling the engine speed at the idling operation. This block diagram is represented using $Z^{-1}$ conversion to introduce the control amount u(i−1) from u (i). This corresponds to that the control amount u (i−1) of a past time is stored in the RAM 53 and then it is read out at the next timing of controlling.

In FIG. 3, a block P1 surrounded by a dashed line denotes a portion for determining an internal condition under the condition that the engine speed is controlled to the target engine speed through feedback; a block P2 denotes a portion (accumulation portion) for determining the integral term uI (i); and a block P3 denotes a portion for operating the control amount u (i) from the state variable amount IX (i) determined by the blocks P1 and P2.

(d) setting of the optimal feedback gain IK

The optimal feedback gain Ik can be determined by the following method, for example.

optimal servo system

It is determined so as to minimize an estimation function J of the optimal feedback gain IK which is given by:

$$J = \sum_{i=0}^{\infty} \{Q\ (Ne\ (i) - NF)^2 + R\ (u\ (i) - u\ (i-1))^2\} \quad (10)$$

where the estimation function J is provided to restrict the motion of the control amount u (i) of the ISC valve 44 as well as to minimize the deviation of the idling engine speed Ne (i) of a control output from the target engine speed NF. Weighting to the restriction of the control amount u (i) can be changed in accordance with values of weighting parameters Q and R. Therefore, the optimal feedback gain $$IK=[K1\ K2\ K3\ K4\ K5\ K6\ K7\ K8\ K9\ Ka] \quad (11)$$

is so determined that: a simulation is repeated with the values of the weighting parameters Q and R changed until the optimal control characteristic is obtained.

The optimal feedback gain IK=[K1 K2 K3 K4 K5 K6 K7 K8 K9 Ka] is dependent on respective constants a1, a2, b1, and b2. Thus, it is necessary to design the optimal feedback gain IK with expectation of changes of the respective constants a1, a2, b1, and b2 in order to ensure a stability (robustness) of the system against change (parameter change) of the system for controlling the idling engine speed Ne.

Therefore, the simulation is carried out in consideration of possible actual changes of respective constants a1, a2, b1, and b2 to determine the optimal feedback gain IK such that it satisfies the stability. As changing factors, changes with the passage of time, such as deterioration of the ISC valve 44 or clogging at the bypass passage and change of loads are possible.

As mentioned above, the modeling of controlled object, the method of representation of the state variable amount, the design of the regulator, and the determination of optimal feedback gain are described. They are predetermined. Thus, the actual control is effected by the electric control unit 20 using these results, that is, the actual control is effected through only Eqs. 1, 8, and 9 using these results.

In this embodiment, the feedback processing using Eqs. 1, 8, and 9 is effected only when the condition of the engine 10 satisfies a predetermined feedback execution conditions. When it does not satisfy the feedback execution condition (open condition), the processing using Eqs. 1, 8, and 9 is not executed by the electric control unit 20 but the control amount u (i) of the ISC valve 44 is determined in accordance with other predetermined processing.

Hereinbelow will be described the idling engine speed control as an example of engine control apparatus with reference to flow charts shown in FIGS. 4 to 8.

Figure 4:
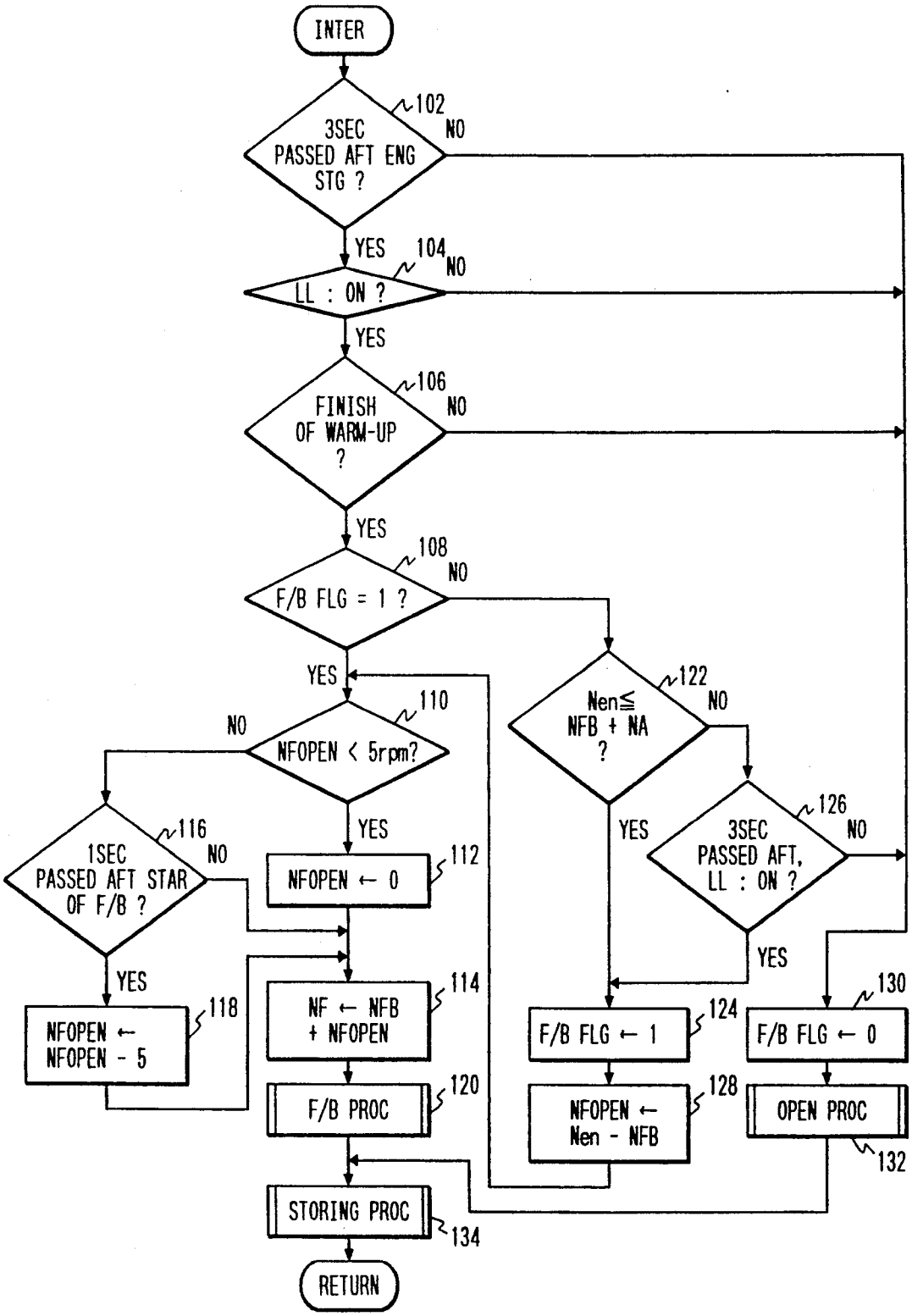
FIG. 4 shows a flow chart of the first embodiment.

FIG. 4 shows a flow chart of the first embodiment of a control program for the ISC valve 44. This processing is executed in response to an interruption occurring at every predetermined interval (for example, every 100 msec) under the condition that a not-shown IG switch is closed.

When processing is started in response to the interruption, at first, in a step 102, a decision is made as to whether three seconds have passed after termination of starting the engine 10. This is because this control should be started after the engine enters the condition that the engine 10 left an unstable condition just after starting of the engine. The termination of the starting of the engine is judged by, for example, the fact that the engine speed Ne of the engine 10 exceeds 500 rpm.

If three seconds have passed after termination of starting engine in the step 102, processing proceeds to a step 104 and a decision is made there as to whether the throttle valve 30 is fully close and the idle switch LL is ON. In the step 104, if the idle switch LL is ON, processing proceeds to a step 106. In the step 106, a decision is made as to whether warm-up has been finished or not. If the warm-up has been finished, processing proceeds to a step 108.

In step 108, a decision is made as to whether a flag (F/B flag) is set to 1, the flag being set to 1 during a feedback (F/B) processing is executed. If the F/B flag is 1, processing proceeds to a step 110.

In step 110, a decision is made as to whether or not a target value increasing amount NFOPEN is less than 5 rpm, the target value increasing amount being set just after the processing condition transients from an open condition to the feedback processing condition. If NFOPEN<5 rpm, the target value increasing amount NFOPEN is set to 0 in a step 112 and processing proceeds to a step 114. If NFOPEN≧5 rpm, a decision is made as to whether one second has passed after start of the F/B processing after transition to the F/B condition in a step 116. If one second has not passed, processing proceeds to the step 114 directly. If one second has passed, the target value increasing amount NFOPEN is changed to a value which is smaller than the prior value by 5 rpm (NFOPEN←NFOPEN-5 rpm) and then, processing proceeds to the step 114. In the step 114, the target engine speed NF is determined by addition of the above-mentioned increasing amount NFOPEN to the reference engine speed NFB (for example, 700 rpm).

In the following step 120, the F/B processing mentioned later is executed in accordance with the target engine speed NF determined in the step 114 mentioned above.

On the other hand, in the step 108, the F/B flag is judged as zero, processing proceeds to a step 122. In the step 122, the latest engine speed Nen obtained on the basis of the signal of the engine speed sensor 29 is compared with a value obtained by addition of a given value NA (for example, 200 rpm) to the reference engine speed NFB. If Nen≦NFB+NA, processing proceeds to a step 124. If Nen>NFB+NA, processing proceeds to a step 126. In the step 126, a decision is made as to whether three seconds has passed after the idle switch LL is turned on. If three seconds has passed, processing proceeds to the step 124.

In the step 124, the F/B flag is set to 1 and processing proceeds to a step 128. The target value increasing amount NFOPEN is obtained by subtraction of the reference engine speed NFB from the latest engine speed Ne and processing proceeds to the step 110. Therefore, the engine speed detected when the F/B processing is judged to be started is set to the initial value of the target engine speed NF at the start of the F/B processing.

Moreover, in the step 102, if three seconds has not passed after engine start or if the idle switch LL is in OFF in the step 104, or if warm-up has not finished in the step 106, or if three seconds has not passed after the idle switch LL is turned on, processing proceeds to a step 130. In the step 130, the F/B flag is set to 0 and then, in the following step 132, the open processing mentioned later is executed.

After processing in the step 120 or in the step 132, in a step 134, a storing processing motioned later is executed to prepare the next feedback processing, and then this control program once ends and processing moves to other engine control programs.

Figure 5:
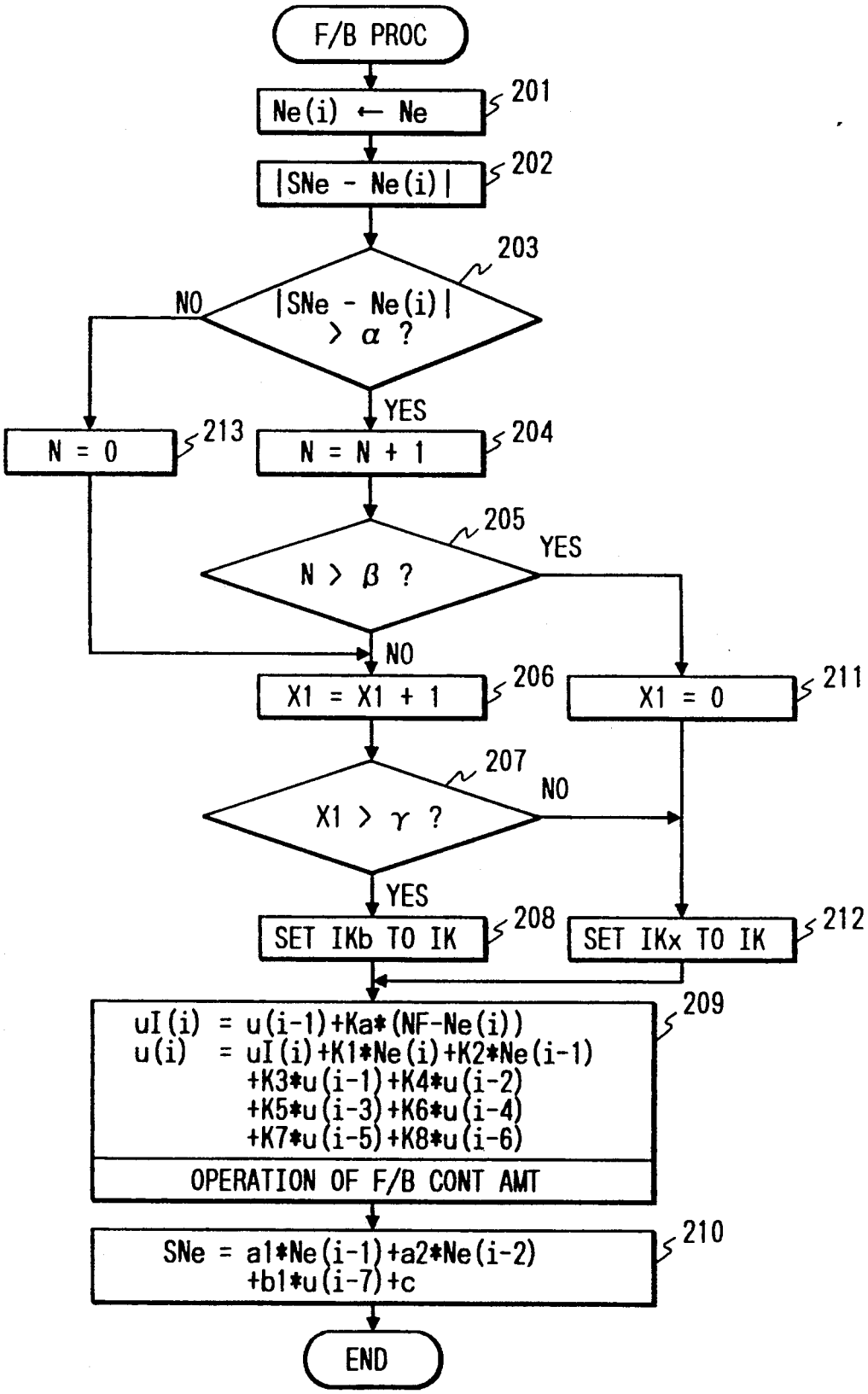
FIG. 5 shows a flow chart of the first embodiment showing the F/B processing of the step 120 shown in FIG. 4.

FIG. 5 shows a flow chart of the first embodiment showing the F/B processing of the step 120 shown in FIG. 4 where the operations of the control amount u (i) and the predicted engine speed SNe are carried out on the basis of the Eqs. 1, 8, and 9 mentioned above.

More specifically, in a step 201, the latest engine speed Ne is substituted for the engine speed Ne (i) of the present time. In the following step 202, an absolute value of difference between the predicted engine speed SNe and the engine speed Ne (i) at the present time |Sne−Ne (i)| is calculated.

The predicted engine speed SNe is obtained from Eq. 1 mentioned above in a step 210 mentioned later. In this embodiment, b2 in Eq. 1 is assumed as zero, so that Eq. 1 is given as follows:

$$SNe = a1.Ne(i) + a2.Ne(i-1) + b1.u(i-6) + C \quad (12)$$

where C is a constant corresponding to the disturbance d (i) and is set to 4.03 in this embodiment. Moreover, a1, a2, and b1 are set to 1.19, −0.19, and 0.35 respectively.

Then, in a step 203, a decision is made as to whether or not the absolute value |Sne−Ne (i)| is larger than a constant $\alpha$. If it is larger than the constant $\alpha$, a counter N is increased by one (N=N+1) in a step 204. Then, in a step 205, a decision is made as to whether or not the counter N exceeds a predetermined value $\beta$. Here, $\alpha$ and $\beta$ are set to 10, for example.

In the following step 205, if the counter N is larger than the predetermined value $\beta$, that is, the events that the deviation of the actual engine speed Ne (i) from the predicted engine speed SNe is larger than $\alpha$ occurs more than $\beta$ times, the counter X1 is reset in a step 211. In the following step 212, an auxiliary feed back constant IKx is set to the optimal feedback gain IK.

Here, the optimal feedback gain IK set in the steps 208 or 212 is introduced from Eq. 10 mentioned above. In Eq. 10, if the parameter Q is assumed constant, the smaller the parameter R, the superior the responsibility of the optimal feedback gain can be determined. However, in this embodiment, the auxiliary feedback gain IKx is determined so that its responsibility is lower than that of the fundamental feedback gain IKb.

After the feedback gain is set in a step 212, the ISC control amount u (i) and the integral term uI (i) are calculated in the following step 209 by that substitution of the auxiliary feedback gain IKx is made in Eqs. 8 and 9 mentioned above. That is, the latest engine speed Ne is set to the present engine speed Ne (i) for operation. Then, a value obtained by product of the deviation of the present engine speed Ne (i) from the target engine speed NF and the integration constant Ka is added to the integral term uI (i−1) which was obtained at the last processing and stored in the RAM 53 to determine the present integral term uI (i). Then, the present control amount u (i) is determined from the present integral term uI (i) and the present engine speed Ne (i) set, and the present state variable amount [Ne (i−1) u (i−1) u (i−2) u (i−3) u (i−4) u (i−5) u (i−6)].

Then, the predicted engine speed SNe is calculated in accordance with Eq. 12 in the following step 210.

In the step 203, if the answer is NO, the counter N is reset (N=0) in a step 213 and then, the counter X1 is increased by one (X1=X1+1) in the step 206. In the step 207, a decision is made as to whether the counter X1 exceeds $\gamma$ (for example, a constant of about ten) or not. This counter X1 maintains IKx for a predetermined interval when the feedback gain is switched from IKx to Ikb. When the counter X1 exceeds $\gamma$, that is, events that the deviation of the actual engine speed Ne (i) from the predicted engine speed SNe is less than $\alpha$ occur more than $\gamma$ times, the fundamental feedback gain IKb is set to the feedback IK gain in a step 208. Then, the feedback control amount is calculated with the fundamental feedback gain IKb in a step 209.

As mentioned, when the control amount u (i) and the predicted engine speed SNe have been calculated with the feedback gain (IKb or IKx) in the steps 209 and 210, this routine ends.

Figure 6:
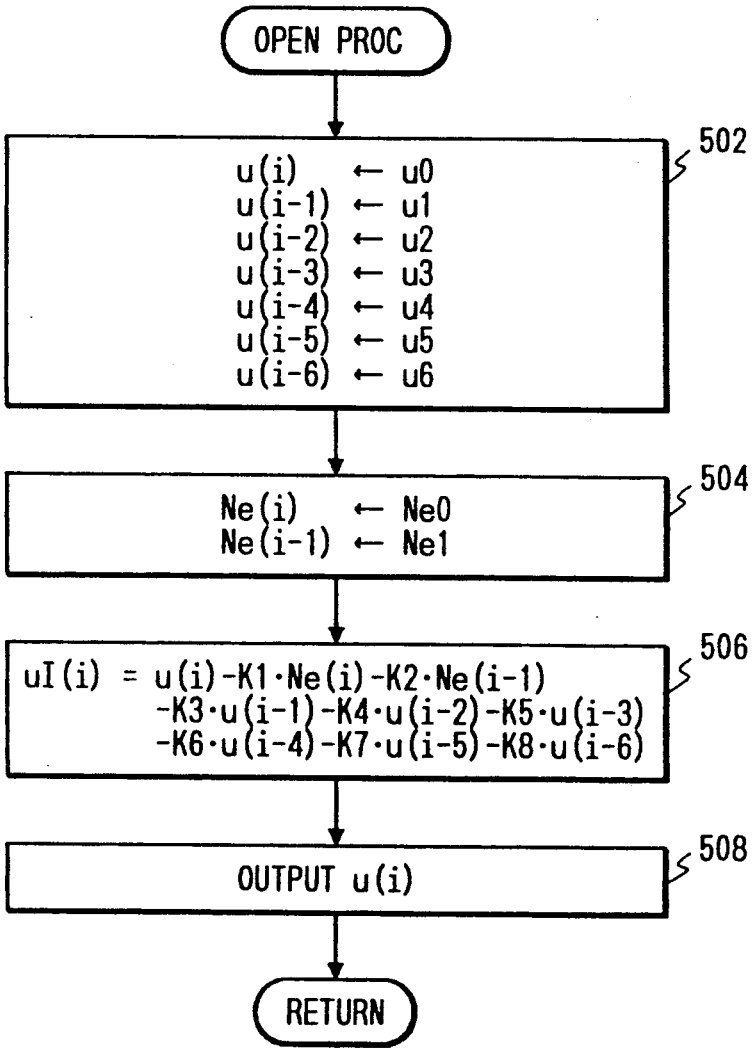
FIG. 6 shows a flow chart of the first embodiment of the open processing of the step 132 shown in FIG. 4.

FIG. 6 shows a flow chart of this embodiment of the open processing of the step 132 shown in FIG. 4. In this open processing, the present control amount u (i) and past control amount u (i−1), u (i−1), u (i−2), u (i−3), u (i−4), u (i−5), u (i−6) is set to predetermined values u0, u1, u2, u3, u4, u5, and u6. The predetermined values u0, u1, u2, u3, u4, u5, and u6 may have given values such as a duty ratio of 100%, 0%, or 50%, or also may have values determined in accordance with a detected parameter such as a temperature of a cooling water THW or the like. Moreover, the past control mounts which were actually calculated and stored in the RAM 53 may be set to the predetermined values.

In a step 504, predetermined values Ne0 and Ne1 are substituted for the present engine speed Ne (i) and the engine speed Ne (i−1) at the last processing respectively. Here, the latest engine speed Ne can be used as the present engine speed Ne (i). Moreover, the actual engine speed Ne at the last control timing, stored in the RAM 53 can be used as the engine speed Ne (i−1) at the last time. Then, in a step 506, an inverse calculation of the integral term uI (i) is performed on the basis of Eq. 5 with the state variable amount obtained from the past control amounts u (i−1), u (i−2), u (i−3), u (i−4), u (i−5), and u (i−6) set in the steps 502 and 504 agreed with the present control amount u (i) set in the step 502.

The state variable amount in this open processing is represented by [Ne (i) Ne (i−1) u (i−1) u (i−2) u (i−3) u (i−4) u (i−5) u (i−6) uI (i) ] obtained from past control amount u (i−1), u (i−2), u (i−3), u (i−4), u (i−5), and u (i−6), the present engine speed Ne (i) set in the step 504, the engine speed Ne (i−1) of the last controlling, and the integral term uI (i) obtained through an inverse operation in the step 506.

In a step 508, a control signal having a duty ratio is produced in accordance with the present control value u (i) set in the step 502 and is sent the ISC valve 44 from an output port 58.

Figure 7:
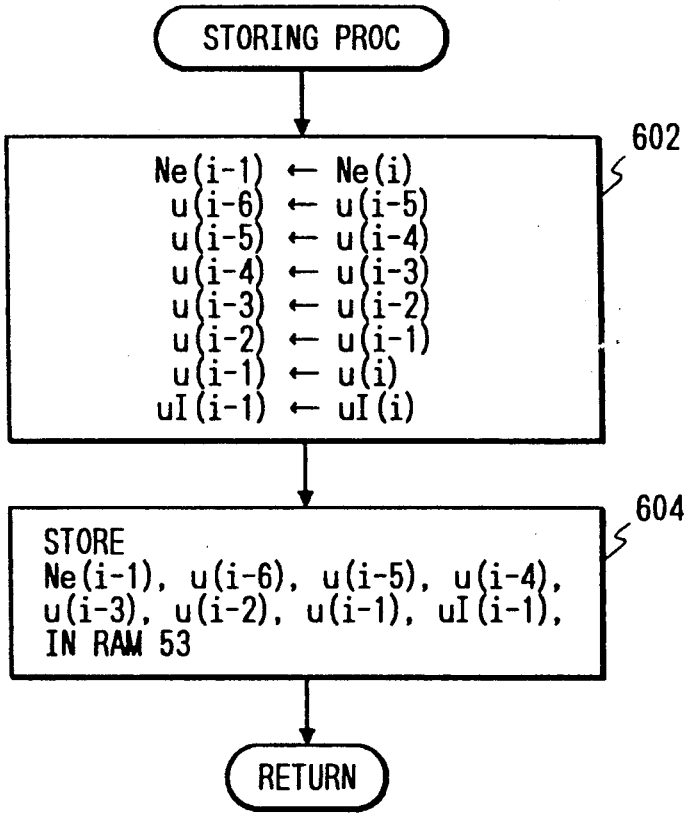
FIG. 7 shows a flow chart of the first embodiment of storing processing of the step 134 shown in FIG. 4.

FIG. 7 shows a flow chart of this embodiment of storing processing of the step 134 shown in FIG. 4.

In this storing processing, Ne (i) u (i−5) u (i−4) u (i−3) u (i−2) u (i−1) uI (i) out of state variable amount set in either of the step 120 (F/B processing) or the step 132 (open processing) executed just before the step 602 is substitute for Ne (i−1), u (i−6), u (i−5), u (i−4) u (i−3), u (i−2), and uI (i−1) respectively. Moreover, the present control amount u (i) determined in the step 120 or the step 132 is substitute for U (i−1).

Then, in a step 604, Ne (i−1), u (i−6), u (i−5), u (i−4), u (i−3), u (i−2), u (i−1), uI (i−1) determined in the step 602 are stored in the RAM 53.

That is, in the storing processing mentioned above, the stored state variable amount is renewed and stored to ready for inverse operation of the integral term in the next F/B processing and for the next open processing using Ne (i) u (i−2) u (i−1) used in the steps 120 and 132, and the control amount u (i) determined in the those steps. In addition, in this embodiment, the state variable amount is stored with its form changed (step 602) so as to be used in the timing of the next operation.

Hereinbelow will be described a second embodiment of this invention. In the first embodiment mentioned above, in the feedback processing, when the deviation of the present engine speed Ne (i) from the predicted engine speed SNe is larger than $\alpha$, the feedback gain is change to the auxiliary feedback constant Ikx which is inferior to the fundamental feedback constant IKb in responsibility. However, when the deviation of the present engine speed Ne (i) from the predicted engine speed SNe is larger than $\alpha$, it is possible that processing is switched from the F/B processing to the open processing. Hereinbelow will be described such embodiment with reference to FIG. 8.

Figure 8:
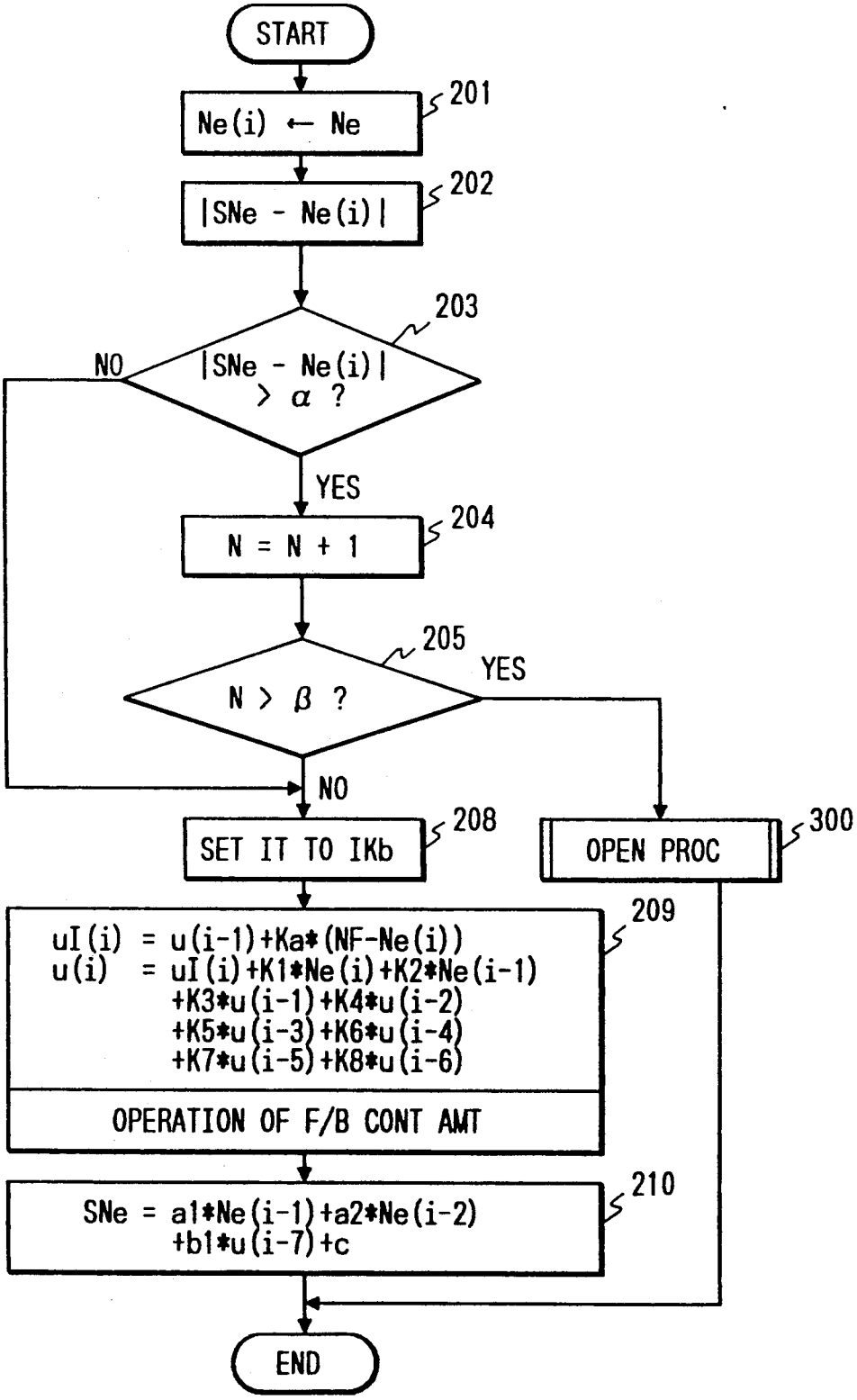
FIG. 8 shows a flow chart of the second embodiment.

FIG. 8 shows a flow chart of the second embodiment showing processing corresponds to the step 120 shown in FIG. 4 and is obtained by modification of the processing shown in FIG. 5. Thus, steps representing the same processing are denoted with the same references as those shown in FIG. 5. The difference of this routine from that of FIG. 5 is in a step 300 substantially. In this embodiment, when events that the deviation of the present engine speed Ne (i) from the predicted engine speed SNe is larger than $\alpha$ occur more than $\beta$ times, the open processing which is also shown in FIG. 6 is executed in the step 300. When the deviation of the present engine speed Ne (i) from the predicted engine speed SNe is less than $\alpha$, in a step 208, the fundamental feedback gain IKb is set to the feedback gain IK. Other processings are the same as mentioned above.

Hereinbelow will be described actual operation of the second embodiment mentioned above with reference to FIGS. 9 and 10.

Figures 9A, 9B, 9C:
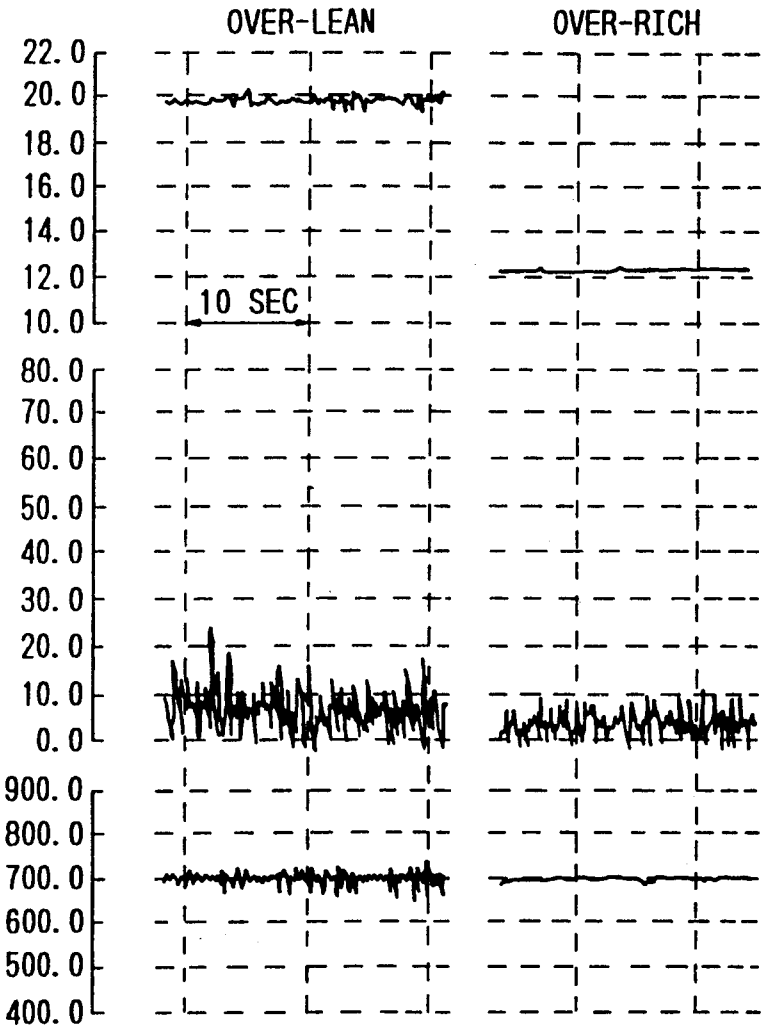
FIGS. 9A, 9B, and 9C show the controlled conditions of the first embodiment shown in FIG. 5.

FIGS. 9A, 9B, and 9C show the controlled conditions of the first embodiment shown in FIG. 5. FIG. 9A shows variations of the air fuel ratio in the over-lean and over-rich conditions. FIG. 9B shows variations of the term of |SNe−Ne (i)| in the over-lean and over-rich conditions. FIG. 9C shows variations of the engine speed Ne in the over-lean and over-rich conditions.

When the deviation of the present engine speed Ne (i) from the predicted engine speed SNe becomes larger, the feedback gain is reduced. That is, as shown in FIG. 5, the ISC control amount is obtained with the feedback constant IKx which is inferior to the fundamental feedback constant IKb in responsibility. That is, they shows fluctuations of the engine speed in over-lean and over-rich conditions to which the above-mentioned model equation Eq. 1 designed under theoretical air fuel ratio cannot be applied.

Figures 10A, 10B:
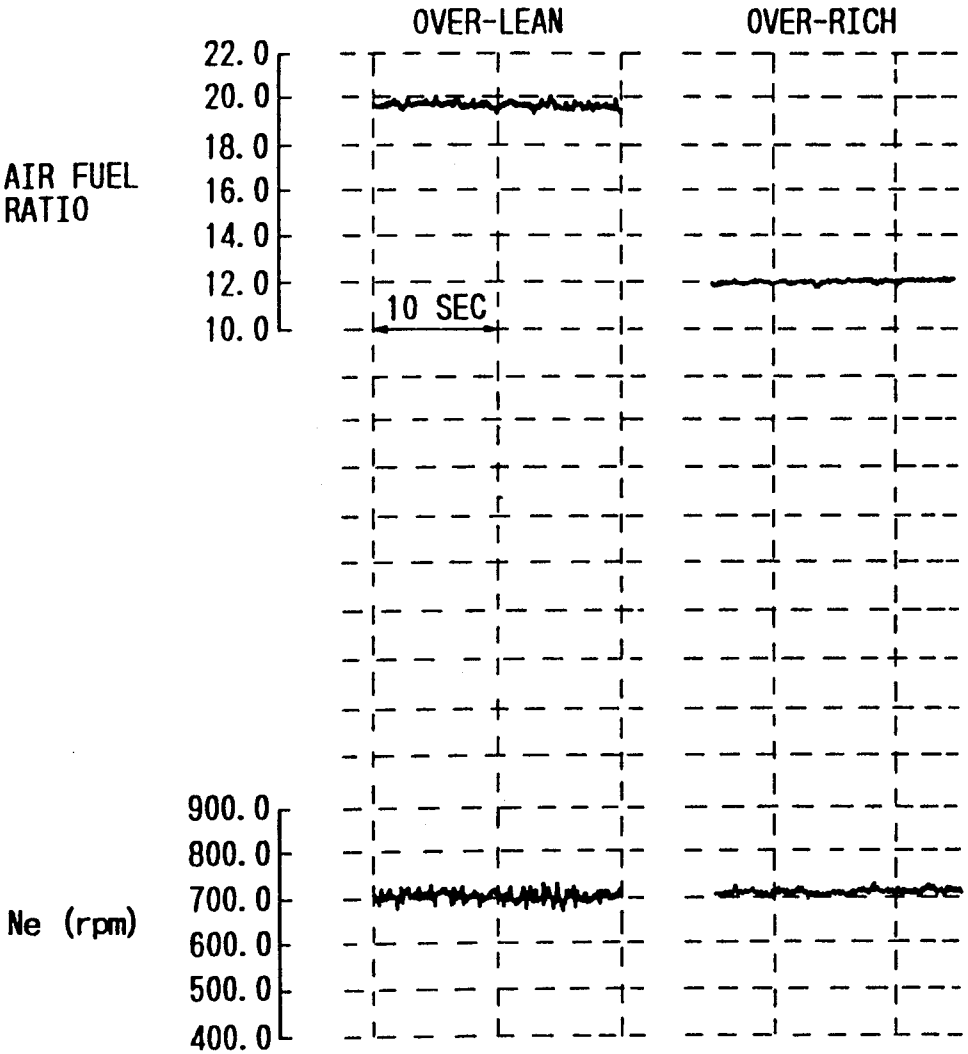
FIGS. 10A and 10B shows the controlled conditions of the second embodiment.
Figures 11A, 11B, 11C:
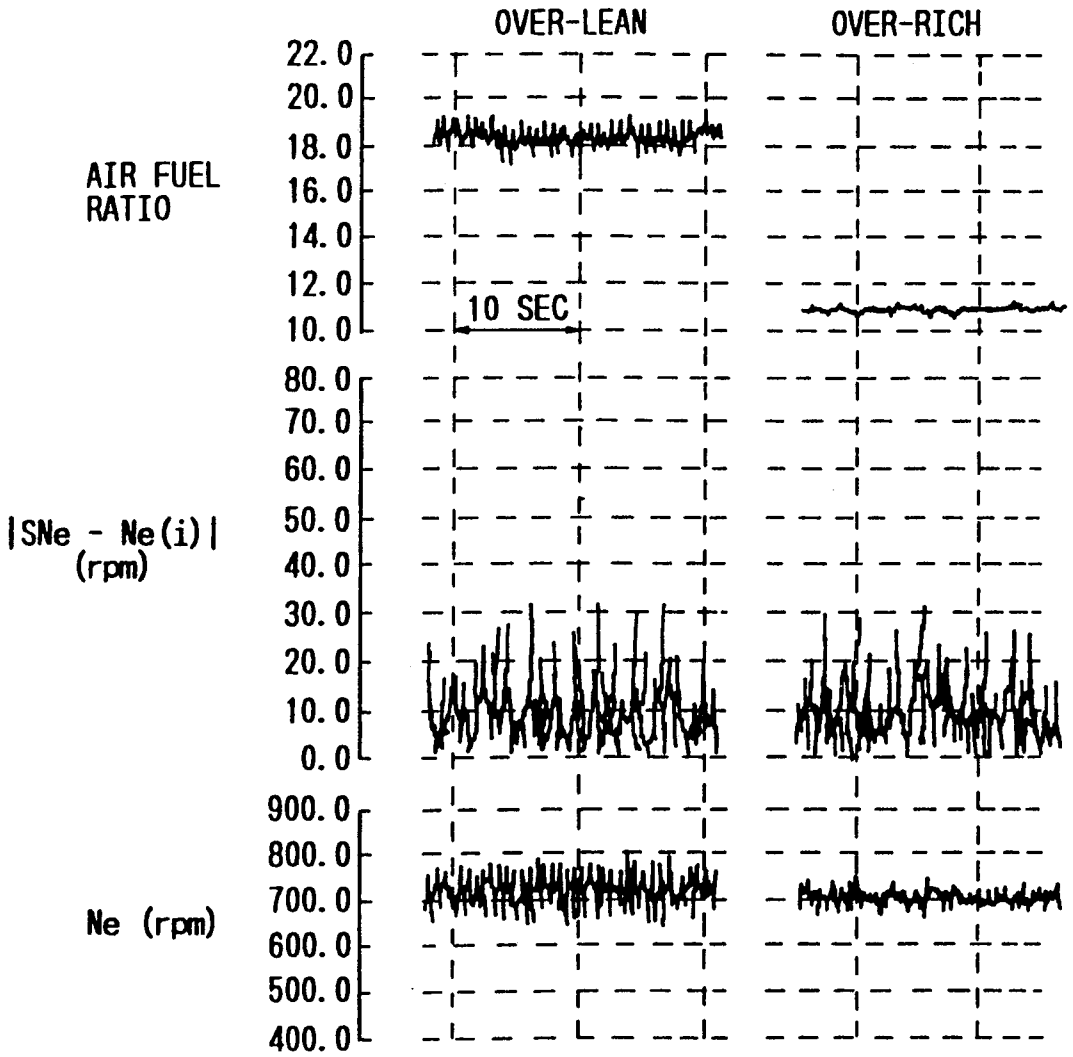
FIG. 11A PRIOR ART
FIG. 11B PRIOR ART
FIG. 11C PRIOR ART
FIGS. 11A, 11B, and 11C show controlled conditions according to the prior art engine control apparatus.

FIGS. 10A and 10B shows the controlled conditions of the second embodiment shown in FIG. 8 wherein processing is changed to the open processing when the deviation of the present engine speed Ne (i) from the predicted engine speed SNe.

The fluctuation of the engine speed is suppressed due to reducing of hunting of the rotating of the engine because in over-lean and over-rich conditions that a model error is larger than those of FIGS. 9 and 10, the deviation of the present engine speed Ne (i) from the predicted engine speed SNe becomes larger and then, control is changed to a control with a feedback gain which is inferior in responsibility to the normal condition or to the open control.

Moreover, as other embodiment, it is possible that a plurality of feedback gains are stored with correspondence to the deviation or absolute value of the present engine speed Ne (i) from the predicted engine speed SNe and then, the feedback gain is selected from those feedback gains in accordance with the deviation or absolute value of the present engine speed Ne (i) from the predicted engine speed SNe.

Hereinbelow will described a third embodiment of this invention.

In the first and second embodiments, the idling engine speed control apparatus for controlling the idling engine speed to a target value are described. However, this invention is applicable to an air fuel ratio control apparatus for controlling an air fuel ratio to a target value.

As mentioned above, according to this invention, fluctuations of the engine speed are suppressed because of prevention of hunting due to reduction of variation in the control amount. This reduction of variation in the control amount is caused by that the feedback gain is changed from one feedback gain to another gain which is inferior to the former in responsibility or processing is changed from the feedback processing to the open processing when the deviation of the actual engine speed from the predicted engine speed becomes larger due to increase in the error in the model, for example, in the over-rich or over-lean condition. Further, the responsiblity of control in the idling engine speed to the target engine speed is improved without increase in manpower for setting the feedback gain in the manufacture or in storing capacity of the electric control unit because the fluctuations in engine speed accompanied with the air fuel ratio variation can be suppressed without increase in the number of inputs of the model.

What is claimed is:

1. An engine control apparatus comprising:

(a) actual control condition detection means for detecting an actual control condition of an engine;

(b) adjusting means for adjusting said actual control condition of said engine; and (c) control means for controlling said adjusting means such that said actual control condition of said engine is controlled to a target control condition using state variable amount and a feedback constant determined on the basis of a dynamic model of said engine, wherein said control means has:

predicated control condition operation means for operating a predicted control condition on the basis of said dynamic model of said engine;

deviation operation means for operating a deviation of said predicated control condition from said target control condition; and changing means for changing control of said control means such that fluctuations of said control condition become small in accordance with a judgement made such that an error of said dynamic model exceeds a tolerance when said deviation exceeds a predetermined value.

2. An engine control apparatus comprising:

actual control value detection means for detecting an actual control value of an engine;

adjusting means for adjusting said control condition of said engine; and control means for operating a control amount for controlling said adjusting means such that said actual control value agrees with said target value and for outputting a control signal in accordance with said control amount;

wherein said control means has:

predicated control amount operation means for operating a predicted control value on the basis of a dynamic model of said engine;

deviation operation means for operating a deviation of said predicated control amount from said actual control value;

integral term operation means for operating an integral term of said deviation of said actual control value from said predicted control amount;

state variable determining means for determining a state variable on the basis of said integral term, said actual control amount, and said control amount;

storing means for storing a first feedback gain predetermined on the basis of said model and a second feedback gain inferior to said first feedback gain in responsibility;

first control amount determining means for determining said control amount in accordance with said first feedback gain and said state variable amount;

second control amount determining means for determining said control amount in accordance with said second feedback gain and said state variable amount; and means for determining said control amount using said first control amount determining means when said deviation from said deviation operation means does not exceed a predetermined value and for determining said control amount using said second control amount determining means when said deviation from said deviation operation means exceeds said predetermined value.

3. An engine control apparatus comprising:

actual control value detection means for detecting an actual control value of an engine;

adjusting means for adjusting said control condition of said engine; and control means for operating a control amount for controlling said adjusting means such that said actual control value agrees with said target value and for outputting a control signal in accordance with said control amount;

wherein said control means has:

predicated control amount operation means for operating a predicted control value on the basis of a dynamic model of said engine;

deviation operation means for operating a deviation of said predicated control amount from said actual control value;

integral term operation means for operating an integral term of said deviation of said actual control value from said predicted control amount;

state variable amount determining means for determining a state variable amount on the basis of said integral term, said actual control amount, and said control amount;

first control amount determining means for determining said control amount on the basis of a first feedback gain predetermined on the basis of said dynamic model and of said state variable amount;

second control amount determining means for setting said control amount to a predetermined value through open processing; and means for determining said control amount using said first control amount determining means when said deviation from said deviation operation means does not exceed a predetermined value and for determining said control amount using said second control amount determining means when said deviation from said deviation operation means exceeds said predetermined value.

4. An engine control apparatus as claimed in claim 2, wherein said predicted control amount operation means comprises operation means having a first input receiving said actual control amount and a second input receiving said control amount and an output for outputting said predicted control amount.

5. An engine control apparatus as claimed in claim 3, wherein said predicted control amount operation means comprises operation means having a first input receiving said actual control amount and a second input receiving said control amount and an output for outputting said predicted control amount.

6. An engine control apparatus comprising:

engine speed detection means for detecting an engine speed of an engine;

engine speed adjusting means for adjusting said engine speed of said engine; and control means for operating a control amount for controlling said engine speed adjusting means such that said engine speed during idling operation of said engine agrees with a target value and for outputting a control signal in accordance with said control amount;

wherein said control means has:

predicated control amount operation means for operating a predicted control value on the basis of a dynamic model of said engine;

deviation operation means for operating a deviation of said predicated control amount from said engine speed;

integral term operation means for operating an integral term of said deviation of said engine speed from said target value;

state variable amount determining means for determining a state variable amount on the basis of said integral term, said engine speed, and said control amount;

storing means for storing a first feedback gain predetermined on the basis of said model and a second feedback gain inferior to said first feedback gain in responsibility;

first control amount determining means for determining said control amount in accordance with said first feedback gain and said state variable amount;

second control amount determining means for determining said control amount in accordance with said second feedback gain and said state variable amount; and means for determining said control amount using said first control amount determining means when said deviation from said deviation operation means does not exceed a predetermined value and for determining said control amount using said second control amount determining means when said deviation from said deviation operation means exceeds said predetermined value.

7. An engine control apparatus comprising:

engine speed detection means for detecting an engine speed of an engine;

engine speed adjusting means for adjusting said engine speed of said engine; and control means for operating a control amount for controlling engine speed adjusting means such that said engine speed during idling operation of said engine agrees with said target value and for outputting a control signal in accordance with said control amount;

predicated engine speed operation means for operating a predicted control value on the basis of a dynamic model of said engine;

deviation operation means for operating a deviation of said predicated engine speed from said engine speed;

integral term operation means for operating an integral term of said deviation of said engine speed from said predicted engine speed;

state variable amount setting means for determining a state variable amount on the basis of said integral term, said engine speed, and said control amount;

first control amount determining means for determining said control amount on the basis of a first feedback gain predetermined on the basis of said dynamic model and of said state variable amount;

second control amount determining means for setting said control amount to a predetermined value through an open processing; and means for determining said control amount using said first control amount determining means when said deviation from said deviation operation means does not exceed a predetermined value and for determining said control amount using said second control amount determining means when said deviation from said deviation operation means exceeds said predetermined value.

8. An engine control apparatus as claimed in claim 6, wherein said predicted engine speed operation means comprises operation means having a first input receiving said engine speed and a second input receiving said control amount and an output for outputting said predicted engine speed.

9. An engine control apparatus as claimed in claim 7, wherein said predicted engine speed operation means comprises operation means having a first input receiving said engine speed and a second input receiving said control amount and an output for outputting said predicted engine speed.

* * * * *